US005192115A

United States Patent [19]

Hartman et al.

[11] Patent Number: 5,192,115

[45] Date of Patent: Mar. 9, 1993

[54] TRAMMING MOBILE MINING MACHINE

[75] Inventors: Thomas M. Hartman, Des Moines, Wash.; David B. Sugden, Tasmania, Australia

[73] Assignee: The Robbins Company, Kent, Wash.

[21] Appl. No.: 706,052

[22] Filed: May 28, 1991

[51] Int. Cl.[5] ..... E21C 29/22; E21C 35/20

[52] U.S. Cl. ..... 299/31; 198/522; 299/64; 299/75

[58] Field of Search ..... 299/31, 33, 56, 64, 299/75; 198/522

[56] References Cited

U.S. PATENT DOCUMENTS

| | | | |
|---|---|---|---|
| 2,776,824 | 1/1957 | Osterhus et al. | 299/75 |
| 3,307,879 | 3/1967 | Bergmann | 299/64 |
| 3,726,562 | 4/1973 | Wharton | 299/12 |
| 3,873,157 | 3/1975 | Stoltefuss et al. | 299/31 |
| 3,929,378 | 12/1975 | Frenvo et al. | 299/64 |
| 3,965,995 | 6/1976 | Sugden et al. | 175/57 |
| 4,045,088 | 8/1977 | Bechem | 299/31 |
| 4,111,488 | 9/1978 | Sigott et al. | 299/10 |
| 4,230,372 | 10/1980 | Marten | 299/39 |
| 4,312,541 | 1/1982 | Spurgeon | 299/31 |
| 4,548,442 | 10/1985 | Sugden et al. | 299/10 |
| 4,998,777 | 3/1991 | Schetina et al. | 299/67 |

FOREIGN PATENT DOCUMENTS

| | | | |
|---|---|---|---|
| 376579 | 5/1973 | U.S.S.R. | 299/64 |
| 587250 | 1/1978 | U.S.S.R. | 299/64 |
| 1293333 | 2/1987 | U.S.S.R. | 299/31 |

*Primary Examiner*—David J. Bagnell

*Attorney, Agent, or Firm*—Graybeal Jackson Haley & Johnson

[57] ABSTRACT

A mobile mining machine for cutting a tunnel in rock has a wheel-like cutterhead assembly supported by a pitch boom assembly that causes movement of the cutterhead assembly in the vertical plane. A swing boom assembly supports the pitch boom assembly and is supported by the base frame of the mobile mining machine. The swing boom assembly causes movement of the cutterhead assembly and the pitch boom assembly in the horizontal plane. During mining, a fixed front support and a fixed rear support anchor the mobile mining machine in the tunnel with front and rear crawlers raised from the tunnel floor. During re-gripping, the front and rear crawlers are lowered to support the mobile mining machine and the fixed front support and fixed rear support remain in contact with the tunnel floor. During tramming, the front and rear supports are raised for transportation of the mobile mining machine on the crawler. A movable muck apron assembly having pivoting apron wings and an integral muck hopper is located on the front portion of the mobile mining machine.

19 Claims, 13 Drawing Sheets

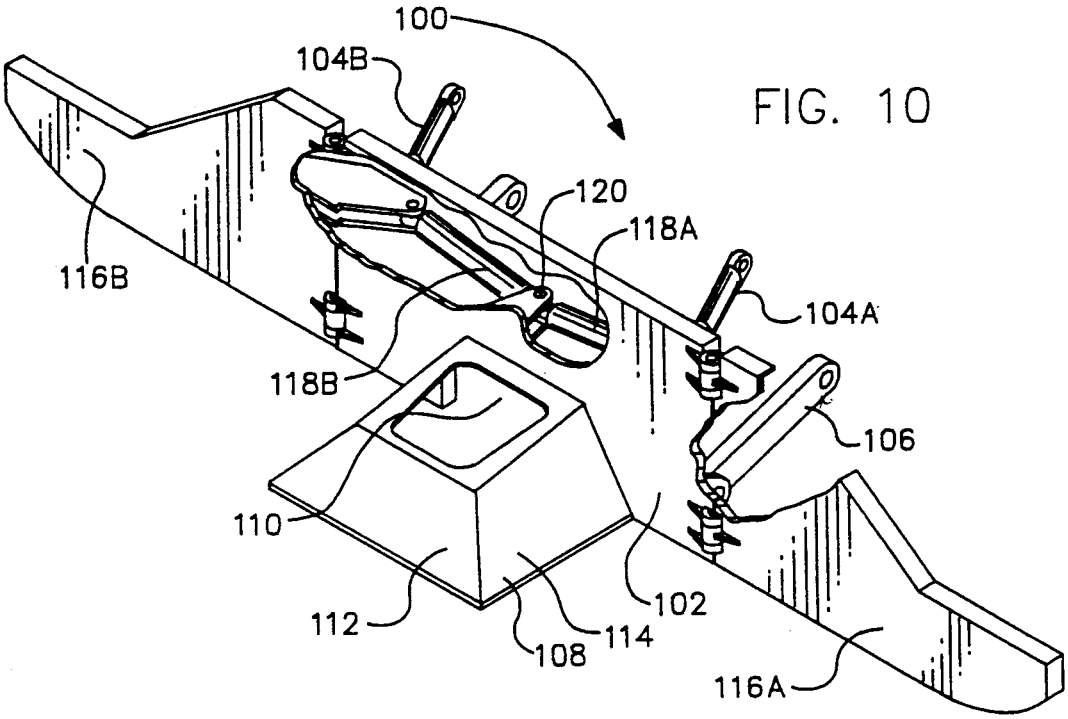
FIG. 10
FIG. 11
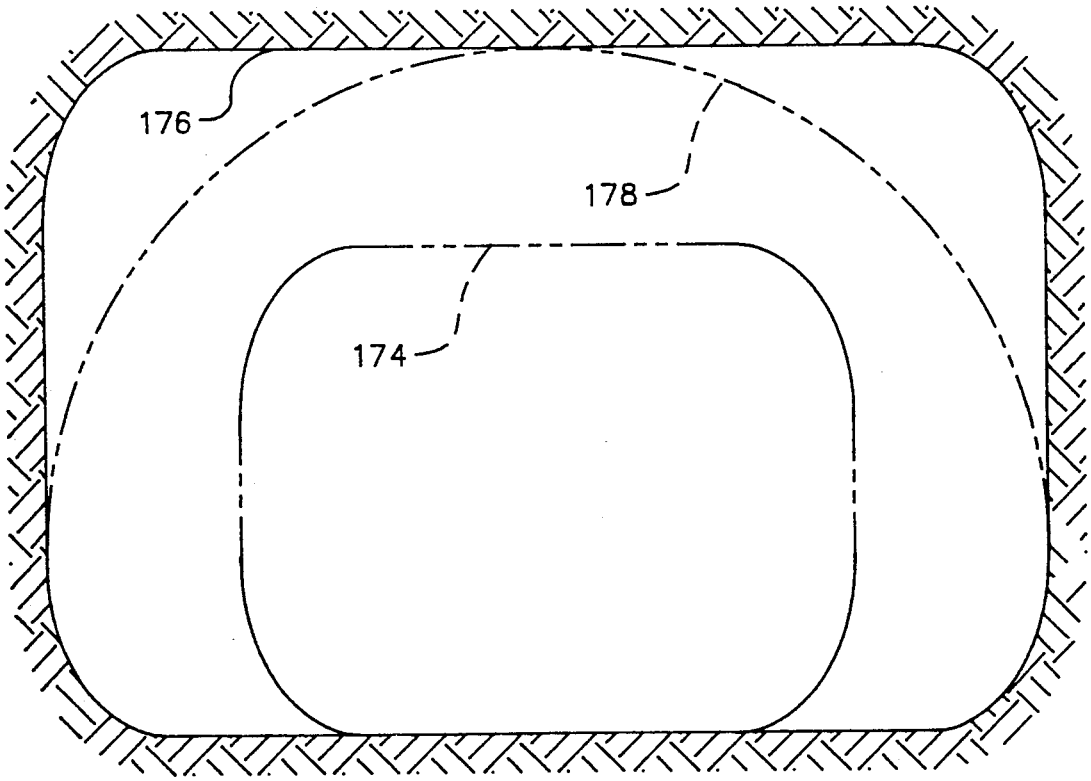

TRAMMING MOBILE MINING MACHINE

BACKGROUND OF THE INVENTION

The invention is in the field of mine tunneling machines, such as machines for cutting large variable cross-section mining tunnels.

The most common known method of forming large mining tunnels in rock is the drill-and-blast method using explosives which has many disadvantages, one of which is that it is very hazardous. Thus, there has been a long-felt need for a mobile mining machine capable of successfully cutting large mining tunnels in rock by mechanical means in order to replace the use of explosives.

Several prior art patents show mining machines which appear to be capable of rotating a cutterhead about a horizontal axis and swinging it across a work face about a vertical axis. Typical of these are Osterhus et al U.S. Pat. No. 2,776,824, Bergmann U.S. Pat. No. 3,307,879, Frenyo et al U.S. Pat. No. 3,929,378, Sigott et al U.S. Pat. No. 4,111,488, and Marten U.S. Pat. No. 4,230,372. All of these prior art patents disclose machines employing toothed or ripper cutter elements rather than disc cutters.

Bechem U.S. Pat. No. 4,045,088 discloses a mining machine which is characterized by oscillation of a so-called drilling head about a vertical pivot axis to arcuately drive a slot cavity, the head and the rotatable disc cutters carried thereby being oscillated through a horizontal angle of about 120°. Plural disc cutters are canted in a diverging manner. No cutter movement is contemplated other than horizontal oscillation.

Stoltefuss et al U.S. Pat. No. 3,873,157 discloses a tunneling or mining machine with the cutting device rotatably mounted on the forward end of a boom which is vertically and horizontally pivotable. The cutting arrangement involves two narrow wheels or rollers carrying pick-like cutters.

Also known is Wharton U.S. Pat. No. 3,726,562 which discloses a coal mining machine having a cutterhead in the shape of a shallow cone rotatably mounted on the forward end of an elongate boom. The cutterhead, although not described in detail, appears to involve a series of picks as the cutting elements. It is not clear from the disclosure of the patent how the cutterhead is rotated and the patent disclosure does not contemplate any particular correlation between the rate of cutterhead rotation and the rate of cutterhead swing. The cutterhead is swingable both horizontally and vertically.

Spurgeon U.S. Pat. 4,312,541 discloses a trench cutting machine comprising a main body assembly and a cutting wheel assembly. This coal mining machine moves plural rows of disc cutters horizontally about a substantially vertical axis to facilitate discharge to a conveyor. A cylinder is mounted transversely on the main body assembly and carries a pair of pistons which extend axially from each end of the cylinder. Gripper pads are provided on each piston to bear against the side walls of the trench. Each piston has an end face within the cylinder which, together with an inner side wall of the cylinder, comprises a pressure chamber adapted to force the pads against the trench. The main body and its cylinder are free to move laterally relative to the pistons when the cylinder is pressurized. Extensible arms are provided between the pistons and the main body assembly for forcing the main body assembly and its cutting wheel forwardly to progessively cut a trench. A steering assembly is provided to shift the main body assembly laterally relative to the pistons and about the central axis of the cutting wheel.

Sugden et al U.S. Pat. No. 4,548,442 teaches a mobile mining machine having a wheel-like cutterhead assembly and having a swing boom assembly located forward of a pitch boom assembly.

A need thus exists for a mobile mining machine having both a pitch boom assembly and a swing boom assembly in which the pitch boom assembly is attached to the cutterhead assembly and the swing boom assembly is connected to the pitch boom assembly and to be mobile mining machine main frame. The above configuration, as differentiated from prior art mining machines having the swing boom attached to the cutterhead and the pitch boom attached to the swing boom and to the mobile mining machine main frame, allow the cutting of a tunnel having a low height to width ratio and optionally having no roof crown.

A need also exists for a mobile mining machine having the above configuration in which the mobile mining machine is anchored to the tunnel floor by fixed, as opposed to hydraulic cylinder type, supports. These fixed supports result in the mobile mining machine being more stable during tunneling.

A need also exists for a mobile mining machine having the above configuration and also including a movable muck apron assembly having pivoting apron wings and an internal muck hopper. The above muck apron assembly facilitates muck collection and is conveniently configured in either mucking or tramming orientation.

SUMMARY OF THE INVENTION

A mobile mining machine for cutting a tunnel in rock, including a wheel-like cutterhead assembly having a substantially horizontal axis of rotation and multiple peripherally mounted roller cutters. A power unit rotates the cutterhead assembly.

A pitch boom assembly supports the cutterhead assembly and causes movement of the cutterhead assembly in a vertical plane.

A swing boom assembly supports the pitch boom assembly and causes movement of the cutterhead assembly and the pitch boom assembly in a horizontal plane.

A frame supports the swing boom assembly and has a front frame portion and a rear frame portion. The front frame portion and rear frame portion are interconnected and rotatable with respect to each other. Interconnection of the front frame portion and the rear frame portion is by thrust cylinders that cause axial reciprocation of the front frame portion and the rear frame portion with respect to each other.

The thrust cylinders thrust forward the front frame portion, the swing boom assembly, the pitch boom assembly and the cutterhead assembly during a mining stroke when in a mining mode.

During a mining stroke a fixed front support and a fixed rear support anchor the mobile mining machine (specifically anchoring the rear frame portion) in the tunnel. The fixed front support has a front support pad adapted to anchor against the tunnel floor and front gripper cylinders adapted to anchor against the tunnel wall during mining. The fixed front support is slidably mounted on the front frame portion for movement of the front frame portion relative to the fixed front support during mining. During tramming of the mobile mining machine the fixed front support and front frame portion are supported on crawler means.

The fixed rear support includes a rear support pad adapted to anchor against the tunnel floor and rear gripper cylinders adapted to anchor against the tunnel wall during a mining forward stroke. The fixed rear support is fixedly mounted on the rear frame portion.

An attachment link connects the fixed front support and the fixed rear support for transfer of thrust and recovery forces therebetween.

Front crawlers are connected to the front frame portion and rear crawlers are connected to the rear frame portion by front lift cylinders and rear lift cylinders, respectively. Retraction of the front lift cylinders and rear lift cylinders configures the mobile mining machine in the gripping configuration for mining, during which the front support pads and rear support pads are anchored against the tunnel floor. Extension of the front and rear lift cylinders in the regripping configuration causes the front crawlers and the rear crawlers to contact the tunnel floor for positioning of the mobile mining machine for the next mining stroke. In this regripping configuration, front support pads and rear support pads still contact the tunnel floor, but do not support the weight of the mobile mining machine. Further extension of the front and rear lift cylinders lifts the front and rear support pads from the tunnel floor for transportation of the mobile mining machine by the front and rear crawlers in the tramming configuration.

When the mobile mining machine is in the gripping configuration for mining, the front frame portion (and the swing boom assembly, pitch boom assembly and cutterhead assembly carried thereby) moves forwardly relative to the fixed front support, fixed rear support and rear frame portion due to forward thrusting of the thrust cylinders.

When the mobile mining machine is repositioned for another mining stroke in the regripping configuration, the fixed front support, fixed rear support and rear frame portion move forwardly relative to the front frame portion due to retraction of the thrust cylinders.

A movable muck apron assembly is located on the front portion of the mobile mining machine and includes pivoting apron wings and an integral muck hopper.

BRIEF DESCRIPTION OF THE DRAWINGS

These and other features of the present invention will be evident when considered in light of the following specification and drawings in which:

FIG. 10 is a perspective view partially in section of the muck apron assembly of the mobile mining machine of FIG. 1A, 1B, and 1C; and FIG. 11 is a cross-sectional view of the maximum tunnel, the minimum tunnel and an exemplary tunnel cut with the mobile mining machine of FIGS. 1A, 1B, and 1C.

DETAILED DESCRIPTION OF THE PREFERRED EMBODIMENT

Figure 1A:
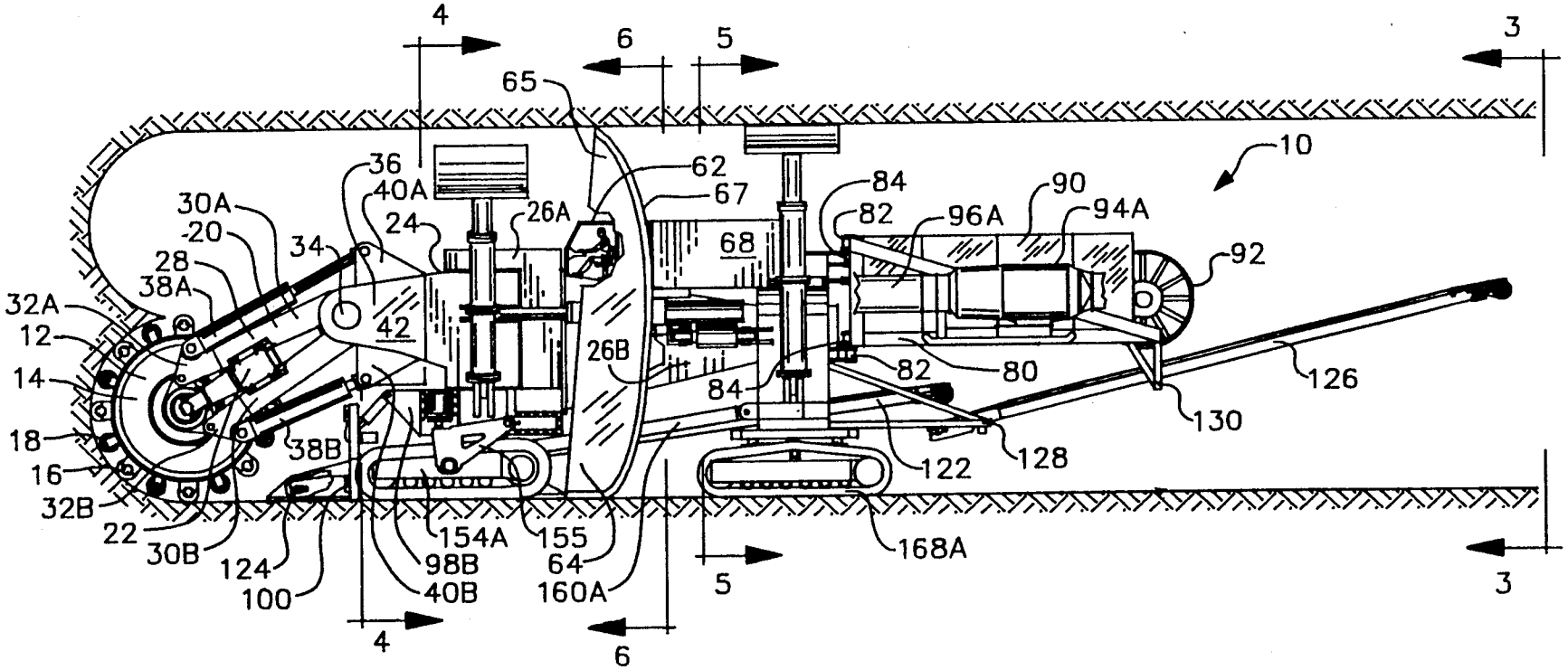
FIG. 1A is a side elevational view of a mobile mining machine typifying the present invention.

Referring to the drawings, the preferred embodiment of the invention is the mobile mining machine 10 which, as shown in FIGS. 1A, 1B, 1C, 2A, 2B and 2C, includes a wheel-like cutterhead assembly 12. The term "mobile mining machine" is to be construed as including machines employed in any and all of mining, tunneling and excavation operations. The cutterhead assembly or cutter wheel 12 consists of a transverse horizontal axis wheel-like drum 14 on which are peripherally mounted a plurality of disc cutters 16 and gauge cutter 18. Drum 14 is rotatably connected to pitch boom assembly 20. Drum 14 is powered by electric drive motor 22 employing gearing and drive trains known in the art.

As disclosed in U.S. Pat. No. 4,548,442 issued to Sugden et al, cutterhead assembly 12 generates the work face profile by plunging forward and moving horizontally from side to side as controlled by swing boom assembly 24. Additionally, pitch boom assembly 20 adjusts with vertical orientation of cutterhead assembly 12 for vertical cuts. If arcuate or angled cuts are desired, both swing boom assembly 24 and pitch boom assembly 20 are simultaneously employed.

The main beam of mobile mining machine 10 is an integral component divided into main beam forward 26A and main beam aft 26B for the sake of description. Swing boom assembly 24 is mounted on main beam forward 26A such that swing boom assembly 24 pivots on a vertical axis as described in further detail below.

Pitch boom assembly 20 connects cutterhead assembly 12 and swing boom assembly 24. Specifically, pitch boom assembly 20 is comprised of pitch boom 28, which is attached to cutterhead assembly 12 such that cutterhead assembly 12 has free rotation relative thereto. Pitch boom 28 is preferably comprised of four pitch boom arms, left upper pitch boom arm 30A, left lower pitch boom arm 30B, right upper pitch boom arm 30C, and right lower pitch boom arm 30D. Each of pitch boom arms 30A through 30D is attached to cutterhead assembly 12 by cutterhead lugs 32A through 32D, respectively, such that cutterhead assembly 12 has free rotation relative to pitch boom 28. The ends of pitch boom arms 30A through 30D not attached to cutterhead assembly 12 are all interconnected with swing boom assembly 24 by pitch bearing 34. Specifically pitch bearing 34 allows vertical movement of pitch boom arms 30A through 30D about a horizontal axis through pitch bearing 34 and relative to swing boom arm lugs 36 and swing boom assembly 24. Left upper pitch cylinder 38A, left lower pitch cylinder 38B, right upper pitch cylinder 38C, and right lower pitch cylinder 38D are each respectively connected to lugs 32A, 32B, 32C, and 32D of pitch boom arms 30A through 30D, respectively. The ends of pitch cylinders 38A through 38D not connected with lugs 32A through 32D respectively are fixedly attached to pitch cylinder clevises 40A through 40D, respectively. Pitch cylinder clevises 40A through 40D are integral with swing boom are lugs 36 of swing boom assembly 24.

Thus, extension of left upper pitch cylinder 38A and right upper pitch cylinder 38C along with retraction of left lower pitch cylinder 38B and right lower pitch cylinder 38D causes relative downward movement of pitch boom 28 and cutterhead assembly 12 with respect to mobile mining machine 10. Alternatively, extension of left lower pitch cylinder and right lower pitch cylinder 38D and retraction of left upper pitch cylinder 38A and right upper pitch cylinder 38C causes relative upward movement of pitch boom 28 and cutterhead assembly 12.

Describing swing boom assembly 24 in detail, swing boom 42, having swing boom arm lugs 36 and pitch cylinder clevises 40A through 40D, is rotatably secured to main beam forward 26A. Specifically, referring to FIGS. 7 and 8, swing boom attachment clevis 44 and base portion 46 of main beam forward 26A contain upper swing bearings 48 and lower swing bearings 50 housed in upper swing boom opening 52 and lower swing boom opening 54 respectively. The aft portion of swing boom 42 resides within upper swing boom opening 52 and lower swing boom opening 54 and moves in a horizontal plane relative to mobile mining machine 10 on upper swing bearing 48 and lower swing bearings 50. On opposite sides of swing boom 42 adjacent main beam forward 26A are left swing cylinder clevis 56A and right swing cylinder clevis 56B. Left swing cylinder clevis 56A secures left swing cylinder 58A to swing boom 42, and right swing cylinder clevis 56B secures right swing cylinder 58B to swing boom 42. The ends of left swing cylinder 58A and right swing cylinder 58B that are not respectively attached to left swing cylinder clevis 56A and right swing cylinder clevis 56B are fixedly secured to left swing cylinder attachment lug 60A and right swing cylinder attachment lug 60B respectively. Left swing cylinder attachment lug 60A and right swing cylinder attachment lug 60B are fixedly secured to the left and right sides of main beam aft 26B. Thus, extension of left swing cylinder 58A and retraction of the right cylinder 58B results in horizontal movement of swing beam 42 and cutterhead assembly 12 in the right hand direction. Alternatively, extension of right swing cylinder 58B and retraction of left swing cylinder 58A causes horizontal movement of swing boom 42 and cutterhead assembly 12 horizontally in the left hand direction.

As shown in FIGS. 1A-B and 2A-B, operator's cab 62 is preferably located on top of main beam aft 26B. All of the machine controls are available to the operator in cab 62.

The dust suppression system consists of a retractable shield 64 having two wings 65, one located on each side of the operator's cab 62. Shield cylinders 66A and 66B are fixedly attached to the wings 65 of shield 64 and also to main beam aft 26B. Shield cylinders 66A and 66B thus cause movement of shield 64 from a retracted position to an extended position in order to suppress dust during mining operations. During tramming, shield cylinders 66A and 66B are employed to move shield 64 from an extended position to a retracted position. Shield 64 includes a skirt 67 around the perimeter thereof that contacts the tunnel wall for a tight seal.

Situated directly behind operator's cab 62 on main beam aft 26B is diesel electric power generator 68, well known in the art.

Figure 7:
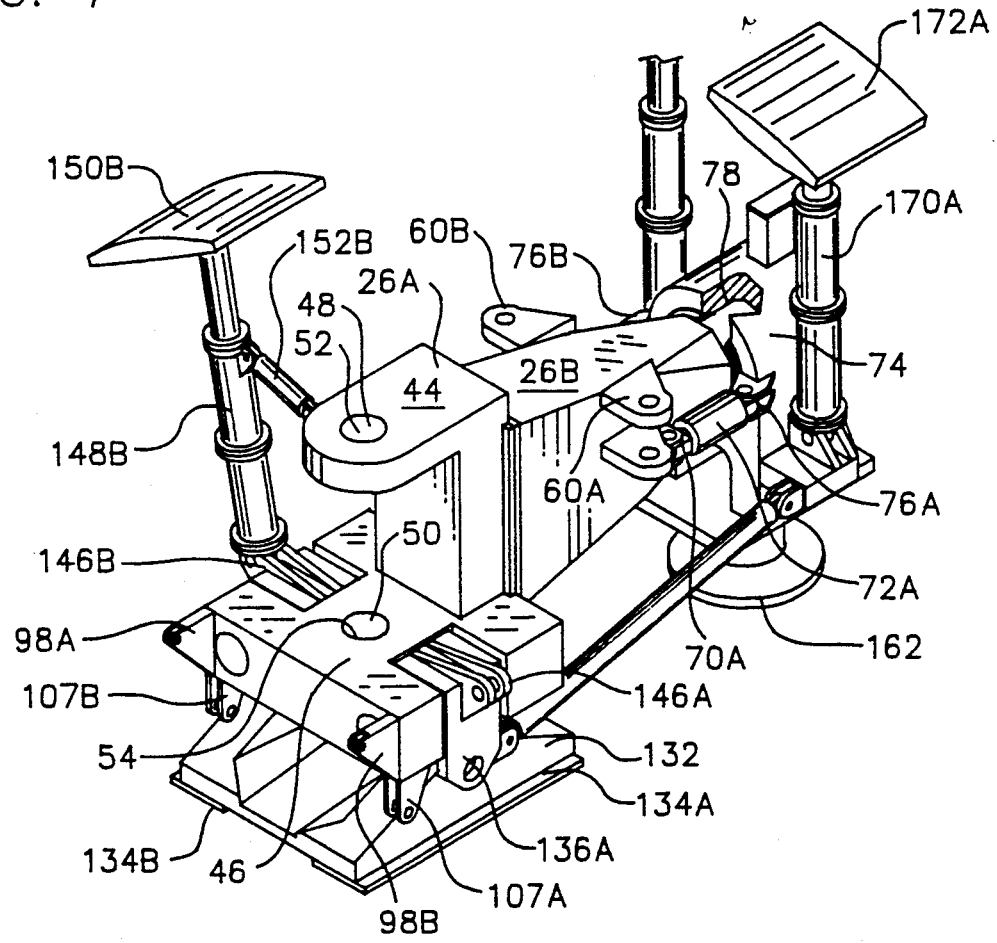
FIG. 7 is a partial perspective view of the main beam, front support assembly and rear support assembly of the mobile mining machine of FIGS. 1A, 1B, and 1C.
Figure 9:
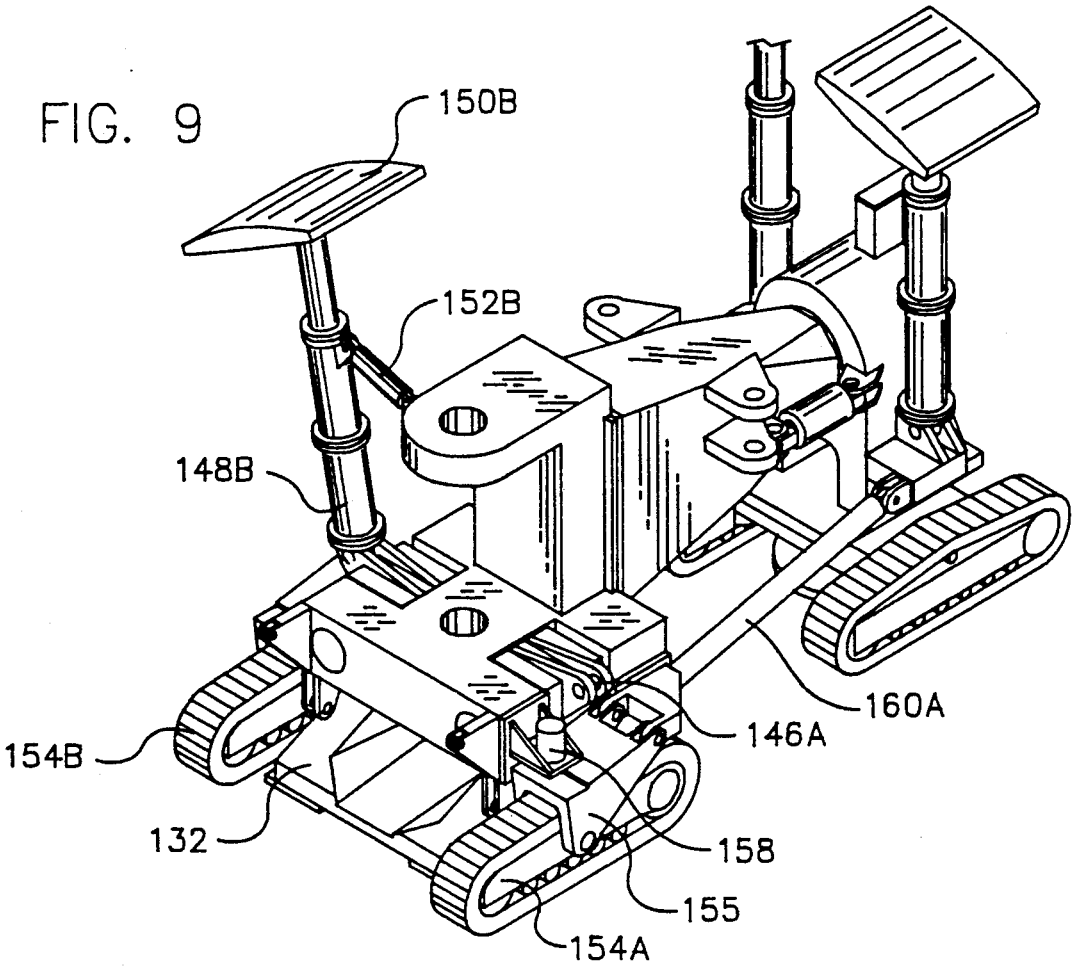
FIG. 9 is a partial perspective view of the main beam, front support assembly, front crawlers, rear support assembly and rear crawlers of the mobile mining machine of FIGS. 1A, 1B, and 1C.

As shown in FIGS. 7 and 9, on the rear portion of main beam aft 26B adjacent left swing cylinder attachment lug 60A and right swing cylinder attachment 60B are propel cylinder lugs 70A and 70B. Connected to propel cylinder lug 70A is left propel cylinder 72A and connected to propel cylinder lug 70B is right propel cylinder 72B. Main beam aft 26B is interconnected with rear support assembly 74 to drive mobile mining machine 10 into a front frame portion and a rear frame portion, respectively. Propel cylinder lugs 76A and 76B are located on rear support assembly 74 near its point of contact with main beam aft 26B. Left propel cylinder 72A is attached to propel cylinder lug 76A and right propel cylinder 72B is attached to propel cylinder lug 76B such tht left propel cylinder 72A and right propel cylinder 72B provide a substantially horizontally directed force between main beam aft 26B and rear support assembly 74.

The interconnection of main beam aft 26A and rear support assembly 74 to define the front frame portion and the rear frame portion is by main bushing 78 of rear support assembly 74. Thus, main beam forward 26A, main beam aft 26B, and the main beam 26 as a whole (i.e. front frame portion), move forwardly within and with respect to rear support assembly 74 (i.e. rear frame portion) when left propel cylinder 72A and right propel cylinder 72B are extended a stroke length of preferably about six inches. Also, when left propel cylinder 72A and right propel cylinder 72B are retracted, rear support assembly 74 (i.e. rear frame portion) moves relatively forwardly toward main beam 26 (i.e. front frame portion) at their point of interconnection at main bushing 78. Additionally, rear support assembly 74 (i.e. rear frame portion) is axially rotatable about main beam aft 26B (i.e. front frame portion) to accommodate the uneven mining terrain when the ground supporting the rear of mobile mining machine 10 is of a different slope than the ground supporting the front of mobile mining machine 10.

Referring to FIGS. 1A, 1C, 2A and 2C, rear support assembly 74 is connected to rear platform 80 by rear platform upper and lower trunnions 82. Rear platform bearings 84 interconnect rear platform trunnion 82 and rear platform 80 such that rear platform 80 swings about rear platform bearings 84 and rear support assembly 74 in a horizontal plane. Facilitating the horizontal planar movement of rear platform 80 are left platform swing cylinder 86A and right platform swing cylinder 86B, which are interconnected between rear support assembly 74 and rear platform 80. Variable elongation and retraction of left platform swing cylinder 86A and right platform swing cylinder 86B with respect to each other cause the horizontal planar movement of rear platform 80 relative to rear support assembly 74. Rear platform 80 carries hydraulic control cabinets 88 and electrical control cabinets 90 and electrical cable reel 92, known in the art.

Located on each side of rear platform 80 are left scrubber 94A and right scrubber 94B, which communicate with left scrubber exhaust duct 96A and right scrubber exhaust duct 96B respectively. Left scrubber exhaust duct 96A and right scrubber exhaust duct 96B are oriented to gather particulate matter adjacent the front portion of mobile mining machine 10.

Referring now to the muck handling system of the present invention, as shown in FIG. 10, the base portion 46 of main beam forward 26A includes a pair of muck apron attachment clevises 98A and 98B, which attach muck aprom assembly 100 to base portion 46. Specifically, center section 102 of muck apron assembly 100 includes, on its rear portion, apron lift cylinders 104A and 104B which interconnect with muck apron attachment clevises 98A and 98B respectively to facilitate lifting of muck apron assembly 100 between a lowered muck receiving position and a raised tramming position. Center section 102 also has attachment links 106 which connect muck apron assembly 100 to the underside of main beam forward 26A at attachment link clevises 107A and 107B. On the front side of center section 102 is hopper 108 having conveyor feed opening 110. Hopper 108 preferably has sloped front and side walls 112 and 114, respectively, that optimize passage of muck into conveyor feeder opening 110. Pivotally attached to center section 102 are left wing 116A and right wing 116B. Left wing 116A and right wing 116B are preferably secured to center section 102 by hinges that allow pivotal movement of left wing 116A and right wing 116B between a tramming orientation in which left wing 116A and right wing 116B are substantially perpendicular to center section 102, and a mucking position in which left wing 116A and right wing 116B are substantially planar relation to center section 102. To facilitate the movement of left wing 116A and right wing 116B between the tramming and mucking positions, apron wing swing cylinders 118A and 118B are respectively attached to left wing 116A and right wing 116B. The opposite ends of both apron wing swing cylinders 118A and 118B are fixedly connected to anchor lug 120 that is attached to center section 102. Thus, extension of apron wing swing cylinders 118A and 118B orients left wing 116A and right wing 116B substantially perpendicular to center section 102 for tramming. Alternatively, retraction of apron wing swing cylinders 118A and 118B orients left wing 116A and right wing 116B substantially in planar relation to center section 102 for mucking.

Referring to FIGS. 1A, 1B, 2A and 2B, forward conveyor 122 is attached to muck apron assembly 100 by forward conveyor forward support 124 and extends rearwardly below mobile mining machine 10 to a location under rear platform 80. At this point, aft conveyor 126 underlaps forward conveyor 122 and is secured by aft conveyor forward support 128. Aft conveyor 126 is also supported by aft conveyor rear support 130 under the rear end of rear platform 80, and communicates with other conveyor means well known in the art at a location behind mobile mining machine 10.

The locomotion and gripping system of mobile mining machine 10 is next described. Referring first to the elements on the front portion of mobile mining machine 10 that allow locomotion and gripping, as shown in FIGS. 1A, 1B, 2A, 2B, 4, 6, 7, 8 and 9, front support assembly 132 includes a pair of rigidly interconnected pads 134A and 134B. Each of pads 134A and 134B is connected to a support trunnion 136A and 136B by a front support trunnion pin 138A and 138B. Front support pads 134A and 134B pivot about a horizontal axis around front support trunnion pins 138A and 138B, respectively. Guide columns 140A and 140B are located in base portion 46 of main beam forward 26A. Guide column bushing 142A and 142B allow movement of base portion 46 and guide columns 140A and 140B relative to each other because guide columns 140A and 140B are slidable within base portion 46. Securedly attached to guide columns 140A and 140B are support trunnions 136A and 136B.

Figure 8:
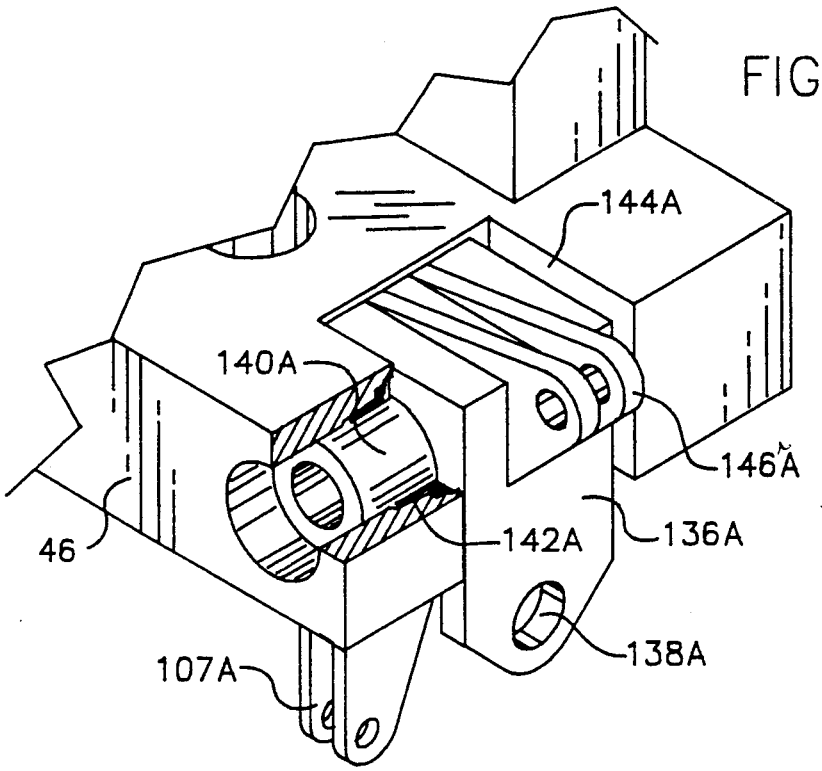
FIG. 8 is an enlarged partial perspective view of the front support trunnion assembly of FIG. 7.

As shown in FIGS. 7, 8 and 9 support trunnions 136A and 136B are secured to guide columns 140A and 140B such that support trunnions 136A and 136B fit within cavities 144A and 144B in base portion 46 of main beam 26 (front frame portion). Cavities 144A and 144B are sized slightly larger than support trunnions 136A and 136B to allow movement of base portion 46 (and front frame portion) relative to guide columns 140A and 140B, support trunnions 136A and 136B, and pads 134A and 134B during mining, and to allow movement of these front support assembly elements relative to base portion 46 (and front frame portion) during tramming of the mobile mining machine 10. Preferably, cavities 144A and 144B allow relative travel of about six inches between base portion 46 and the above support assembly elements, i.e. the stroke lengths of left propel cylinder 72A and right propel cylinder 72B. Affixed to each of the support trunnions 136A and 136B is one of left forward gripper cylinder clevis 146A and right forward gripper cylinder clevis 146B. Attached to left forward gripper cylinder clevis 146A and right forward gripper cylinder clevis 146B, respectively, are left forward gripper cylinder 148A and right forward gripper cylinder 148B. Left forward gripper cylinder 148A has left forward gripper shoe 150A attached to an end thereof. Right forward gripper shoe 150B is attached to an end of right forward gripper cylinder 148B. As shown in FIGS. 4 and 7-9, left forward gripper position cylinder 152A and right forward gripper position cylinder 152B each respectively connects left forward gripper cylinder 148A and right forward gripper cylinder 148B to main beam forward 26A such that left forward gripper cylinder 148A and right forward gripper 148B can be swung radially outwardly around left forward gripper cylinder clevis 146A and right forward gripper cylinder clelvis 146B respectively. In this manner, left forward gripper shoe 150A and right forward gripper shoe 150B can best grip tunnel walls of varying heights and widths. It is readily apparent that the tunnel wall is gripped with left forward gripper shoe 150A and right forward gripper shoe 150B when left forward gripper cylinder 148A and right forward gripper cylinder 148B are extended until pressure contact with the tunnel wall occurs.

Figure 1B:
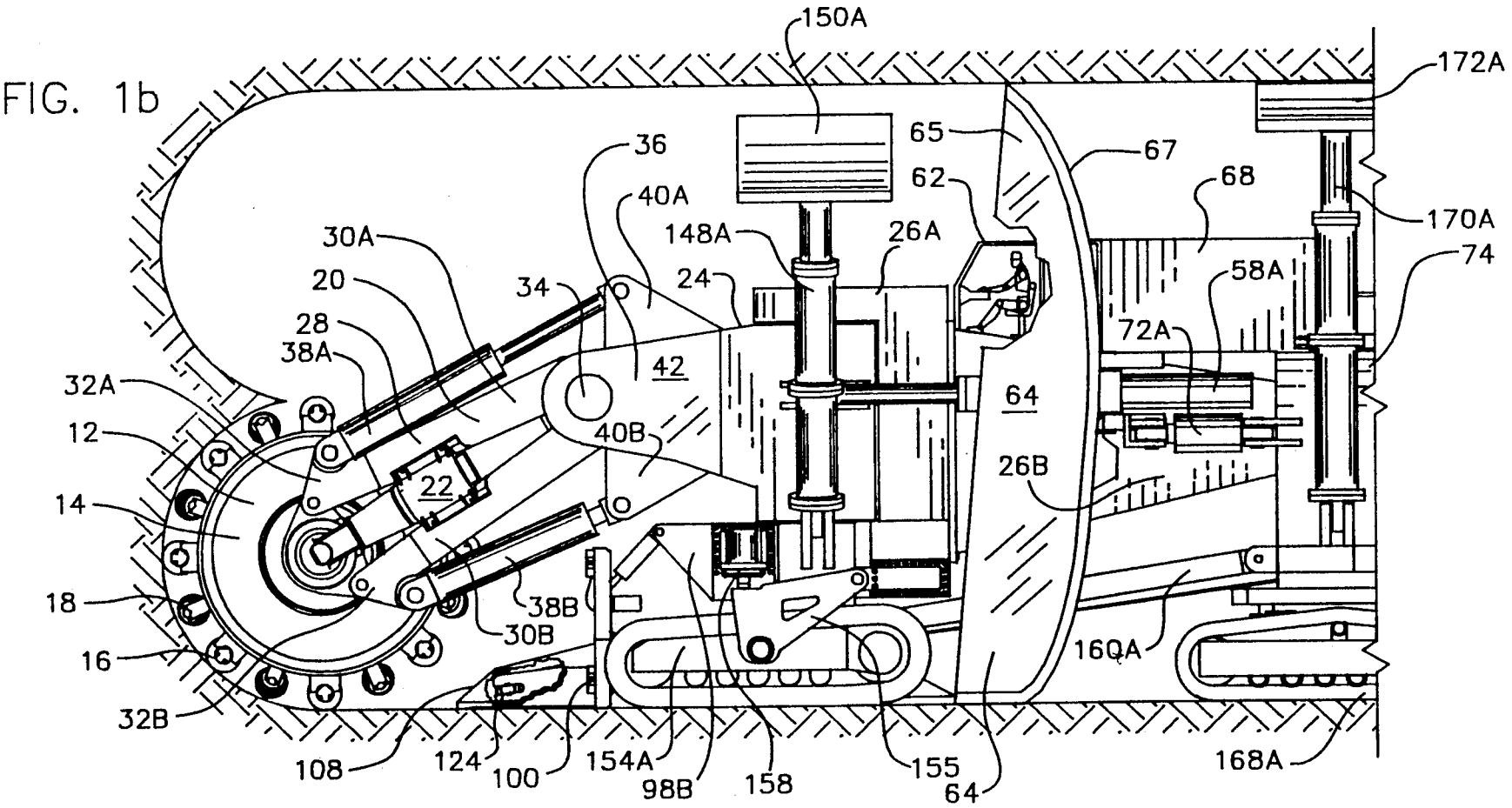
FIG. 1B is an enlarged portion of FIG. 1A showing the front section of a mobile mining machine typifying the present invention.
Figure 1C:
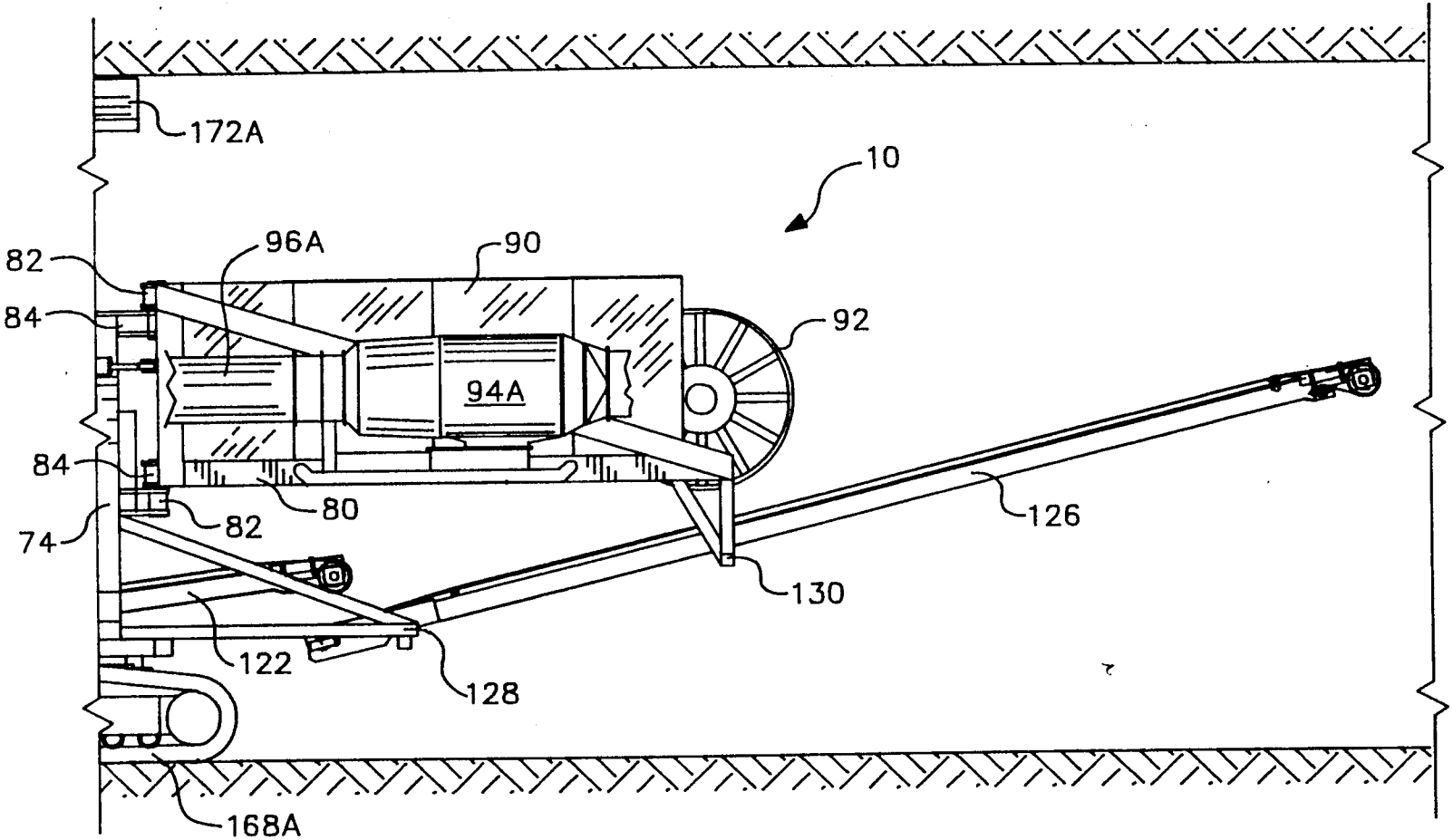
FIG. 1C is an enlarged portion of FIG. 1A showing the rear section of a mobile mining machine typifying the present invention.
Figure 2A:
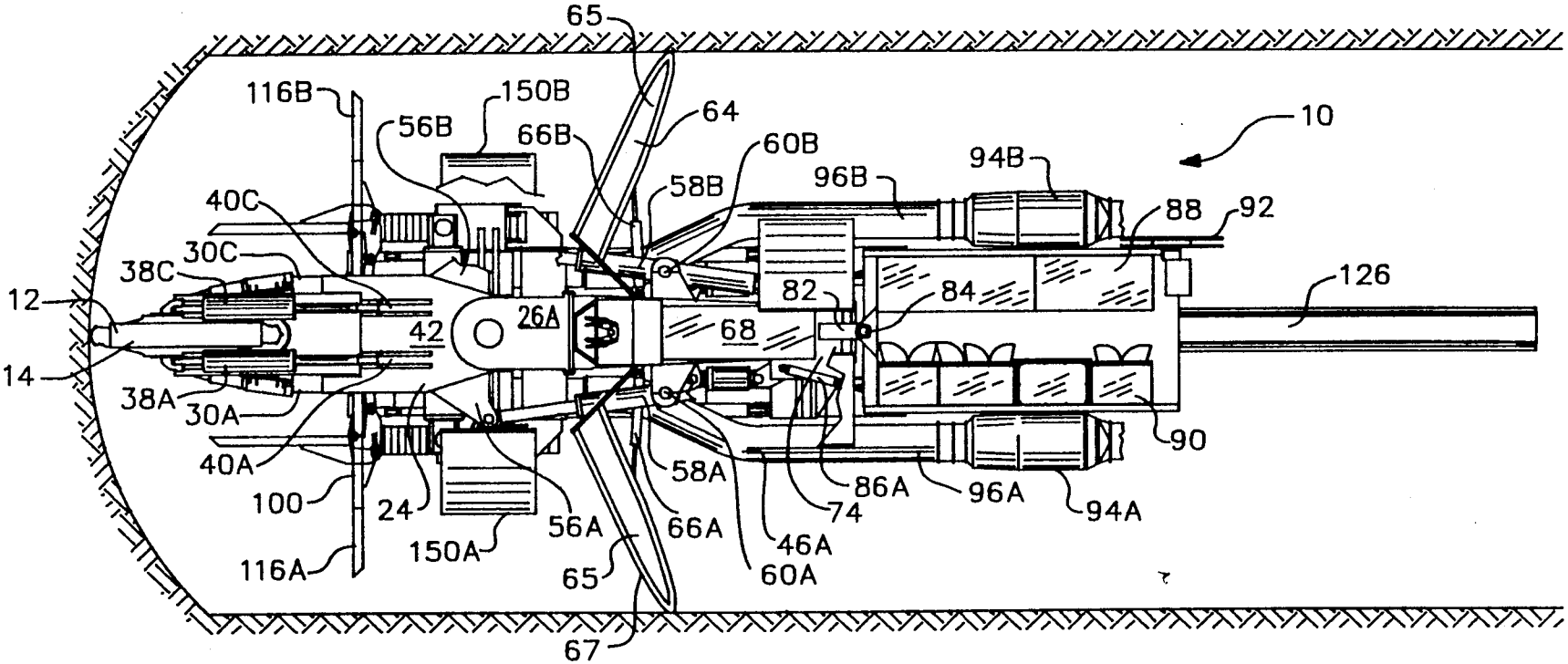
FIG. 2A is a top view partially in section of the mobile mining machine illustrated in FIG. 1A.
Figure 2B:
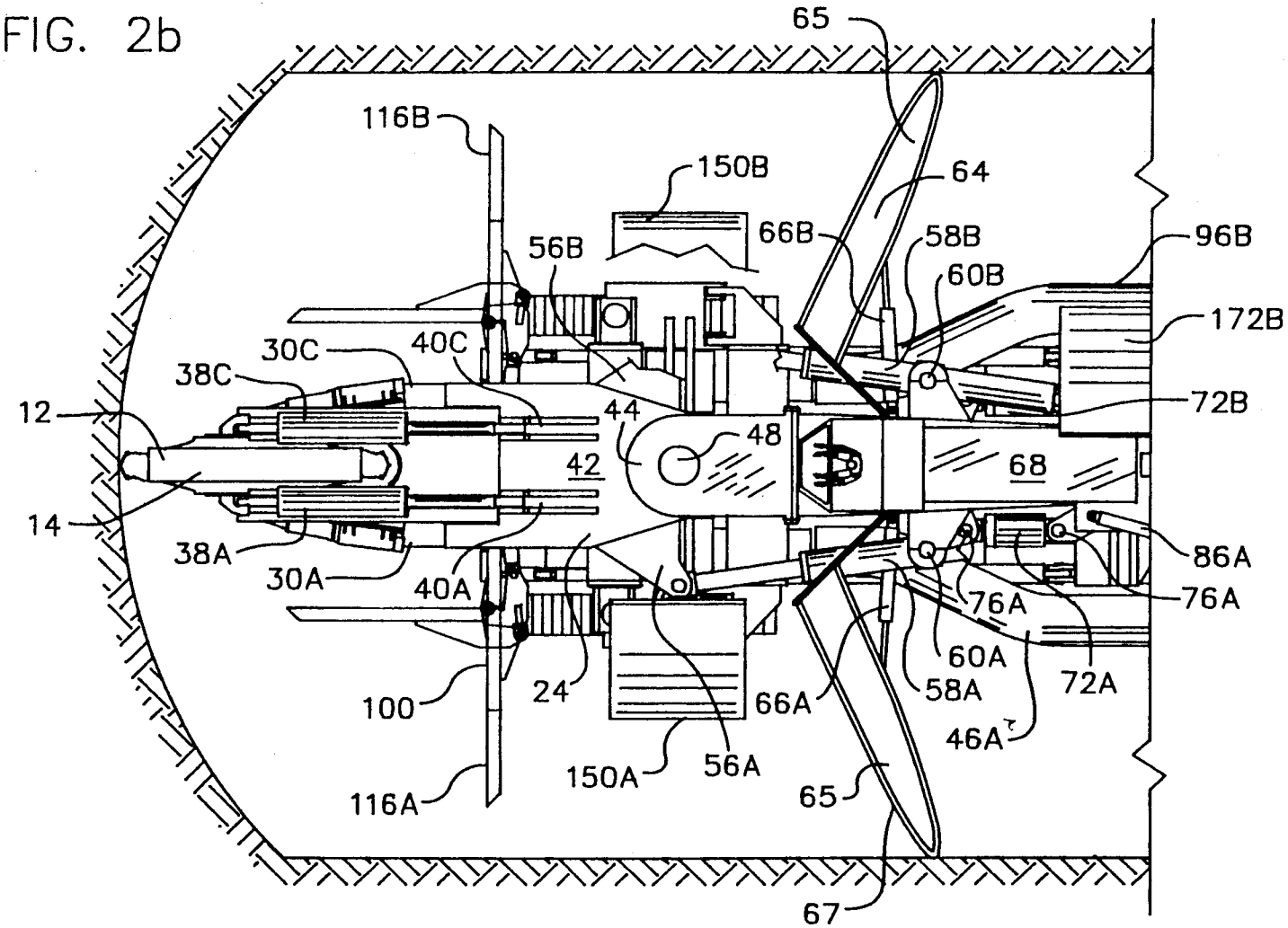
FIG. 2B is an enlarged portion of FIG. 2A showing the front section of the mobile mining machine of FIG. 2A.
Figure 2C:
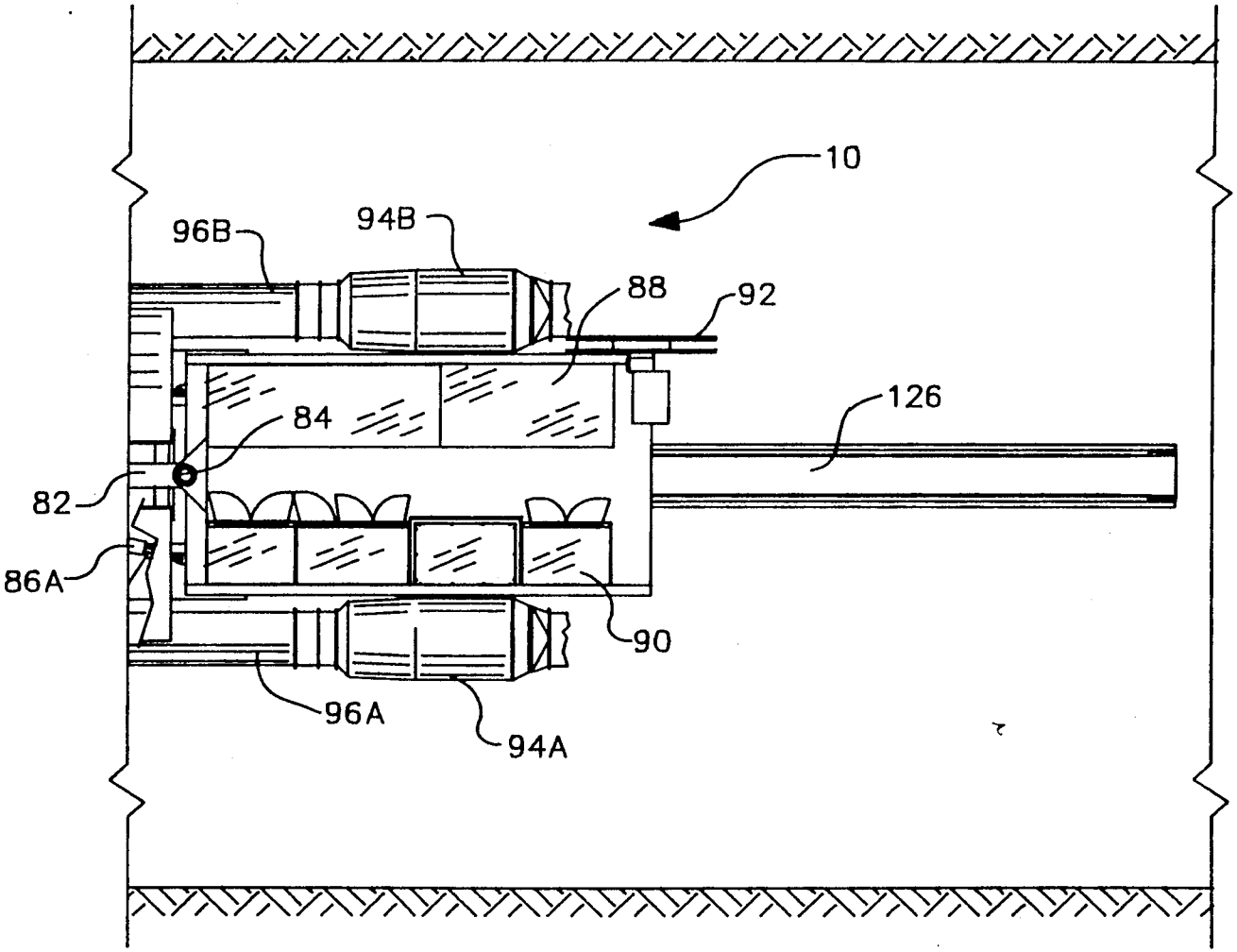
FIG. 2C is an enlarged portion of FIG. 2A showing the rear section of the mobile mining machine of FIG. 2A.
Figure 3:
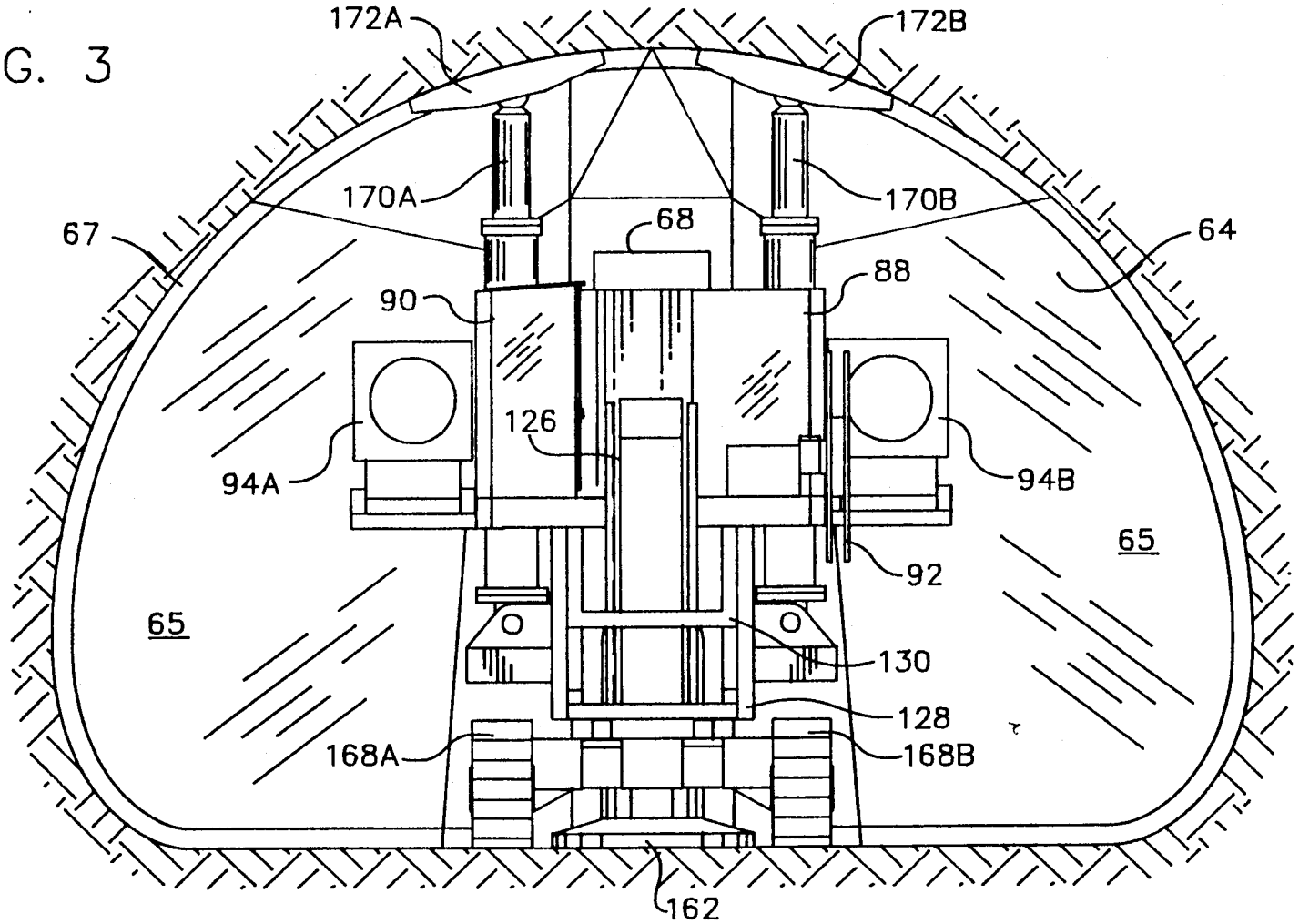
FIG. 3 is a rear view of the mobile mining machine of FIGS. 1A, 1B, and 1C.
Figure 4:
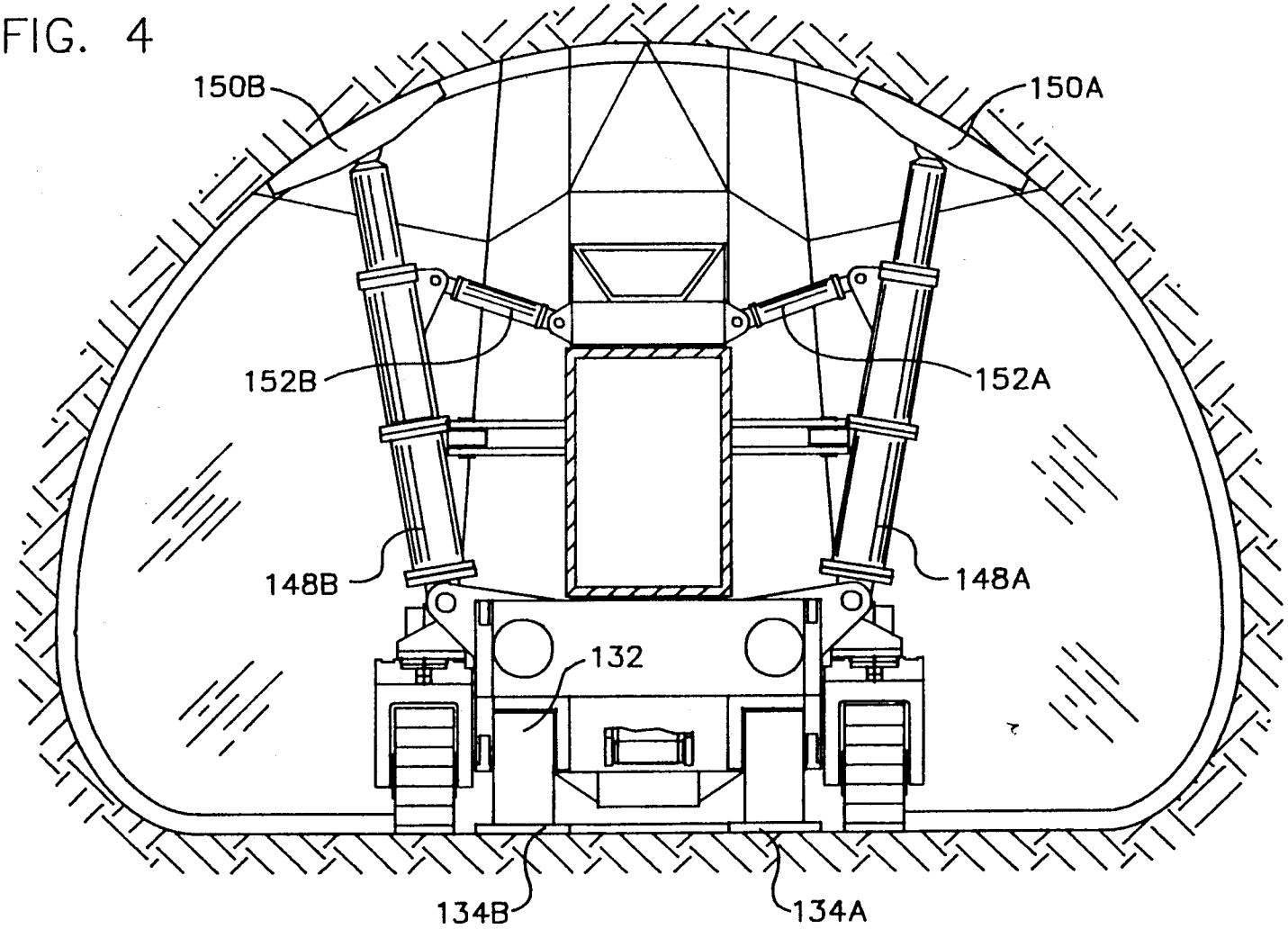
FIG. 4 is a cross-sectional view of the mobile mining machine of FIGS 1A, 1B, and 1C taken along line 4—4 thereof.
Figure 5:
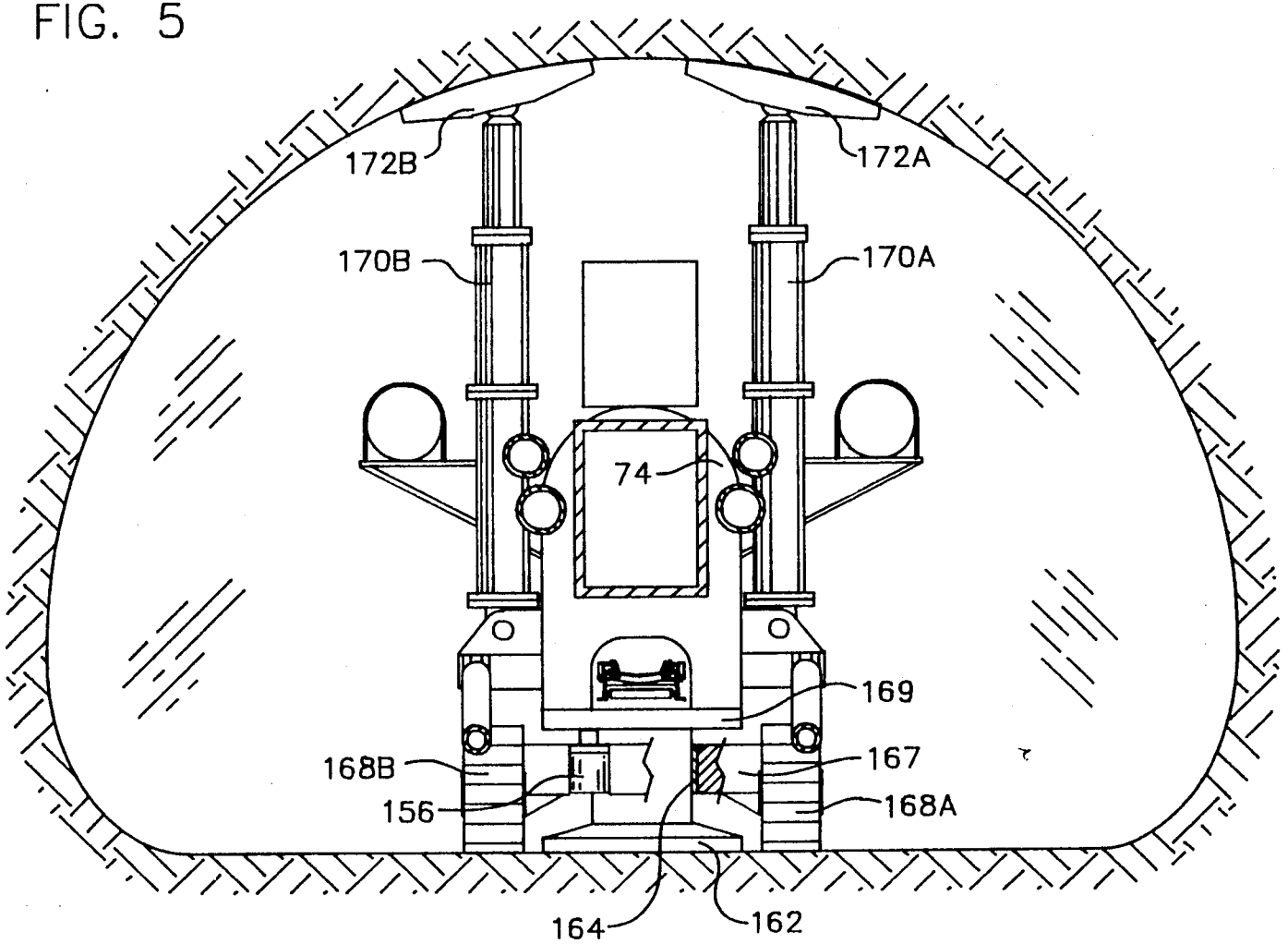
FIG. 5 is a cross-sectional view of the mobile mining machine of FIGS. 1A, 1B and 1C taken along line 5—5 thereof.
Figure 6:
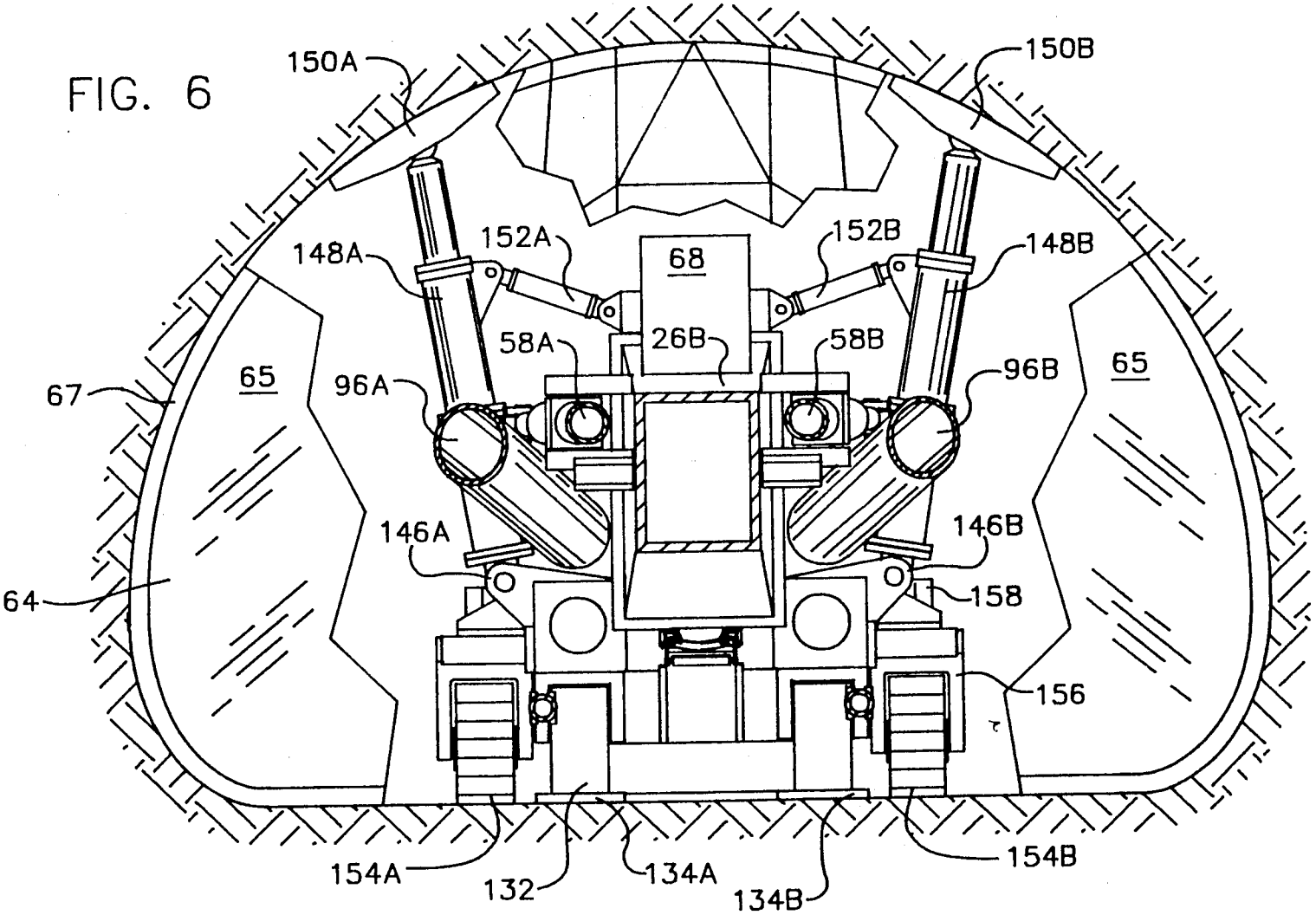
FIG. 6 is a cross-sectional view of the mobile mining machine of FIGS. 1A, 1B, and 1C taken along line 6—6 thereof.

Straddling each side of front support assembly 132 and base portion 46 are front crawlers 154A and 154B. The front crawlers are preferably powered tread assemblies known in the art. As shown in FIG. 1A and 1B, front crawlers 154A and 154B are securedly attached to base portion 46 by yoke 155.

Front lift cylinders 158 are employed to transfer the front portion of mobile mining machine 10 between the mining configuration in which front support assembly 132 is contacting the tunnel floor and left forward gripper shoe 150A and right forward gripper shoe 150B are contacting the tunnel wall, and both the tramming configuration (i.e. transportation of mobile mining machine from place to place) and the re-gripping configuration (i e. repositioning of mobile mining machine 10 for the next mining stroke) in which front crawlers 154A and 154B contact the tunnel floor. Front lift cylinders 158 are attached to crawlers 154A and 154B such that, when front lift cylinders 158 are retracted, thus lowering the forward portion of mobile mining machine 10, pads 134A and 134B engage the tunnel floor for gripping, and the front crawlers 154A and 154B are not in contact with the tunnel floor. In this mining mode the left forward gripper cylinder 148A and right forward gripper cylinder 148B are extended such that left forward gripper shoe 150A and right forward gripper shoe 150B contact the tunnel wall.

In the tramming mode and re-gripping mode front lift cylinders 158 are extended thus raising the front portion of mobile mining machine 10 with the front crawlers 154A and 154B in contact the tunnel floor. For tramming only, and not in the re-gripping mode, front lift cylinders 158 are further extended such that pads 134A and 134B of front support assembly 132 no longer contact the tunnel floor. In the tramming mode and the re-gripping mode, left forward gripper cylinder 148A and right forward gripper cylinder 148B are also retracted such that left forward gripper shoe 150A and right forward gripper shoe 150B no longer constrain mobile mining machine 10 from tramming.

Next the elements of the rear portion of mobile mining machine 10 that facilitate locomotion and gripping will be described. As shown in FIGS. 1A, 1C, 2, 2C, 3, 5 and 9, substantially horizontal connecting links 160A and 160B are each located on one side of main beam aft 26B and interconnect front support assembly 132 and rear support assembly 74. Horizontal connecting links 160A and 160B serve to integrate front support assembly 132 and rear support assembly 74. Thus, during mining, left propel cylinder 72A and right propel cylinder 72B thrust main beam forward 26A and main beam aft 26B in the forward direction, and the front support assembly 132 and rear support assembly 74 are both securely and rigidly planted on the floor of the tunnel. Additionally, in the re-gripping mode, when the weight of mobile mining machine 10 is on the crawlers and left propel cylinder 72A and right propel cylinder 72B are being retracted, horizontal connecting link 160A and 160B ensure that both rear support assembly 74 (i.e. rear frame portion) and front support assembly 132 move forwardly relative to main beam forward 26A and main beam aft 26B (i.e. front frame portion).

Rear support assembly 74 (i e. rear frame portion) includes rear support pad 162 mounted on a downward extension of rear support assembly 74. Located on each side of rear support assembly 74 on rear crawler frame 167 are rear crawlers 168A and 168B that are axially rotatable relative to rear support assembly 74 around slew bearings 164. Rear crawlers 168A and 168B are powered tracks that facilitate steering of mobile mining machine 10 by differential tractive effort between rear crawler 168A and rear crawler 168B. As is known, the differential tractive effort may be different track speeds of rear crawler 168A and 168B in either the same direction or opposite directions. Rear lift cylinders 156 are located in rear crawler frame 167 and bear against the bottom of thrust plate 169, which arrangement separates rear support assembly 74 and support pad 162. Rear lift cylinders 156 thus are attached to rear support assembly 74 such that, when rear lift cylinders 156 are retracted, the rear portion of mobile mining machine 10 is lowered downwardly until rear support pad 162 contacts the tunnel floor in the gripping configuration for mining. Further retraction of rear lift cylinders 156 lifts the rear crawlers 168A and 168B such that the rear crawlers 168A and 168B are not in contact with the tunnel floor.

Attached to rear support assembly 74 adjacent horizontal connecting links 160A and 160B are left rear gripper cylinder 170A and right rear gripper cylinder 170B. Left rear gripper cylinder 170A has left rear gripper shoe 172A on an end, and right rear gripper cylinder 170B has right rear gripper shoe 172B on an end. Left rear gripper cylinder 170A and right rear gripper cylinder 170B are substantially vertically disposed with respect to mobile mining machine 10 such that extension of these cylinders results in left rear gripper shoe 172A and right rear gripper shoe 172B contacting the tunnel wall.

The gripping and re-gripping and tramming operation of mobile mining machine 10 proceeds as follows. As discussed above "gripping" refers to securing mining machine 10 in the tunnel such that a mining stroke can be performed, "re-gripping" refers to the repositioning of mobile mining machine 10 with respect to the tunnel face prior to the next mining stroke, and "tramming" refers to transportation of mining machine 10 from one location to another. First, the desired vertical orientation of cutterhead assembly 12 is selected by relative movement of pitch boom assembly 20, i.e. by extension and/or retraction of pitch boom cylinders 38A through 38D. To establish the mobile mining machine 10 in gripping mode for mining, front lift cylinders 158 are retracted to establish pads 134A and 134B of front support assembly 132 in contact with the tunnel floor, which raises front crawlers 154A and 154B from the tunnel floor. Also, rear lift cylinders 156 are retracted, thereby contacting rear support pad 162 with the tunnel floor and lifting rear crawlers 168A and 168B from the tunnel floor. Simultaneously, left forward gripper cylinder 148A and right forward gripper cylinder 148B are extended so that left forward gripper shoe 150A and right forward gripper shoe 150B engage the tunnel wall. At this time the lateral orientation of left forward gripper cylinder 148A and right gripper cylinder 148B can be adjusted by means of left forward gripper position cylinder 152A and right forward gripper position cylinder 152B. Left rear gripper cylinder 170A and right rear gripper cylinder 170B are also extended such that left rear gripper shoe 172A and right rear gripper shoe 172B contact the tunnel wall. Mobile mining machine 10 is now in gripping mode and configured for a mining stroke. During mining forward, left propel cylinder 72A and right propel cylinder 72B are extended such that main beam 26 (i.e. front frame portion) moves forwardly approximately six inches, in increments of approximately 0.5 to 1 inch per sweep, relative to front support assembly 132 (specifically support trunnions 136A and 136B and pads 134A and 134B and guide columns 132A and 132B) and rear support assembly 74 (i.e. rear frame portion). Forward movement of main beam 26 (i.e. front frame portion) occurs at main bushing 78 where main beam aft 26B is interconnected with rear support assembly 74 (i.e. rear frame portion). The above extension of left propel cylinder 72A and right propel cylinder 72B forces cutterhead assembly 12 into the rock face. Drive motor 22 rotates drum 14 of cutterhead assembly 12. During the mining sweep, swing boom 42 is moved in a horizontal plane in either a left to right or right to left direction by actuation of left swing cylinder 58A and right swing cylinder 58B. Alternatively, if a vertical cut or a cut with a vertical component is desired, pitch boom 28 is employed instead of or along with swing boom 42. As will be apparent, any desired arcuate or angled cut may be realized, with pitch boom 28 and swing boom 42 being pivotally actuated selectively. Muck is best collected in conveyor feed opening 110 of hopper 108 of muck apron assembly 100, which is deployed in the mining configuration. In the gripping configuration, muck apron assembly 100 is in lowered position and left wing 116A and right wing 116B are essentially planar with center section 102.

After the mining stroke is completed, mobile mining machine 10 is configured for re-gripping in order to reposition mobile mining machine 10 for the next mining stroke. Front gripper cylinders 148 and rear gripper cylinders 170 are retracted, thus disengaging forward gripper shoes 150 and rear gripper shoes 172 from contacting the tunnel wall. Front lift cylinders 158 and rear lift cylinders 156 are extended, thus raising pads 134A and 134B of front support assembly 132 and pad 162 of rear support assembly 74, respectively, clear of the tunnel floor. The extension of the front lift cylinders 158 and rear lift cylinders 156 can be limited, thus resulting in raising of the mobile mining machine 10 such that front crawlers 154A and 154B and rear crawlers 168A and 168B now support the weight of mobile mining machine 10, with pads 134A and 134B of front support assembly 132 and pad 162 of rear support assembly 74 still contacting the tunnel floor. Next, left propel cylinders 72A and right propel cylinders 72B are retracted, thus causing forward movement of rear support assembly 74 (i.e. rear frame portion) relative to main beam 26 (i.e. front frame portion). Specifically, axial movement of rear support assembly 74 by about six inches over the portion of main beam aft 26A in main bushing 78 occurs. Additionally, retraction of left propel cylinder 72A and right propel cylinder 72B causes forward movement relative to base portion 46 of front support assembly 132, (and specifically pads 134A and 134B, support trunnions 136A and 136B, and guide columns 140A and 140B) by about six inches. This relative movement of front support assembly 132 is facilitated by horizontal connecting links 160A and 160B which tie together front support assembly 132 and rear support assembly 74. After front support assembly 132 and rear support assembly 74 have moved forward relative to main beam 26, mobile mining machine 10 is again configured for another mining stroke since left propel cylinder 72A and right propel cylinder 72B have been retracted.

To configure the mobile mining machine 10 in the tramming mode, front lift cylinder 158 and rear lift cylinder 156 are further extended to lift front support pads 134A and 134B, and rear support pad 162 from the tunnel floor. At this time, since front crawlers 154A and 154B and rear crawlers 168A and 168B alone contact the tunnel floor, mobile mining machine 10 can either be moved forward in a straight line or can be maneuvered by the crawlers 168A and 168B to change direction. After the tramming movement of the mobile mining machine 10, the above steps are repeated to cycle the machine through its gripping and re-gripping modes.

FIG. 11 shows the shapes and relative sizes of the minimum tunnel 174 and the maximum tunnel 176 able to be mined by mobile mining machine 10. Tunnel 178 is an exemplary tunnel having a size between that of minimum tunnel 174 and maximum tunnel 176. It is readily apparent, however, that mobile mining machine 10 can mine a tunnel of any shape and size between minimum tunnel 174 and maximum tunnel 176.

Minimum tunnel 174 is sized such that mobile mining machine 10 can pass therethrough. Thus, the shape and size of minimum tunnel 174 is dictated by the lateral size of mobile mining machine 10.

Regarding maximum tunnel 176, its width is a function of the travel of swing boom 42 in a horizontal plane. Preferably the travel of swing boom 42 is +45°. The height of maximum tunnel 176 is based on the travel of pitch boom 28 in a vertical plane. Preferably, the travel of pitch boom 28 is +33°, however the travel is up to +45°.

The pitch boom 28 and swing boom 42 travel parameters, and thus the height and width of maximum tunnel 176, are also determined by the diameter of cutterhead 14. Specifically, it is desirable to produce a full cut in the rock face in a maximum of two passes of cutterhead assembly 12. If mobile mining machine 10 extends beyond the above swing and pitch parameters for pitch boom 28 and swing boom 42, three passes of the cutterhead are needed to produce a full cut in the rock face.

Regarding the unique configuration of maximum tunnel 176 and minimum tunnel 174, the small height-to-width ratios of these tunnels (i.e. wide tunnel with low ceiling) and the avoidance of any arc in the crowns of these tunnels (i.e. flat roof) are achieved by reason of the cutterhead assembly 14 being connected to pitch boom 28, and the pitch boom 28 being connected to swing boom 42. The above cutterhead assembly/pitch boom/swing boom configuration results in mobile mining machine 10 being more stable (i.e. "stiffer") for mining a wide tunnel with a low ceiling, when compared to a mining machine having the cutterhead assembly connected to the swing boom, and the swing boom connected to the pitch boom, as disclosed in U.S. Pat. No. 4,548,442 issued to Sugden et al.

The above described embodiments are intended to be descriptive, not restrictive. The full scope of the invention is defined by the claims, and any and all equivalents are included.

We claim:

1. A mobile mining machine for cutting a tunnel in rock, comprising a wheel-like cutterhead assembly means for cutting rock, said cutterhead assembly means having a substantially horizontal axis of rotation and having multiple peripherally mounted roller cutter units;

rotation means for rotating said cutterhead assembly means about its horizontal axis;

pitch boom assembly means supporting said cutterhead assembly means, said pitch boom assembly means causing vertical movement of said cutterhead assembly means;

swing boom assembly means supporting said pitch boom assembly means, said swing boom assembly means causing horizontal movement of said cutterhead assembly means and said pitch boom assembly means;

frame means having front and rear portions supporting said swing boom assembly means;

thrust means mounted on said frame means between the front and rear portions thereof for thrusting forward as a unit the front portion of said frame means, said swing boom assembly means, said pitch boom assembly means and said cutterhead assembly means;

holding means for holding stationary the rear portion of said frame means when said thrust means is thrusting forward, said holding means being adapted to anchor said rear portion of said frame means relative to the tunnel; and transport means for tramming said mobile mining machine.

2. The mobile mining machine of claim 1, wherein said front frame portion and said rear frame portion are interconnected and adapted to reciprocate axially with respect to each other.

3. The mobile mining machine of claim 2, wherein said front frame portion and said rear frame portion are interconnected by said thrust means, and said front frame portion and said rear frame portion are axially rotatable with respect to each other.

4. The mobile mining machine of claim 2, wherein said holding means comprises:

fixed front support means having front support pad means adapted to anchor against the tunnel floor and front gripper cylinder means adapted to anchor against the tunnel wall, said fixed front support means being slidably mounted on said front frame portion on an axis longitudinal of said mobile mining machine for relative movement of said fixed front support means and said front frame portion with respect to each other;

fixed rear support means having rear support pad means adapted to anchor against the tunnel floor and rear gripper cylinder means adapted to anchor against the tunnel wall, said fixed rear support means being fixedly mounted on said rear frame portion; and attachment link means connecting said fixed front support means and said fixed rear support means.

5. The mobile mining machine of claim 4, wherein said transport means comprises:

front crawler means movable with respect to said front frame portion by front lift cylinder means; and rear crawler means movable with respect to said rear frame portion by rear lift cylinder means whereby retraction of said front lift cylinder means and said rear lift cylinder means configures said mobile mining machine in a gripping configuration in which said front support pad means and said rear support pad means are anchored against the tunnel floor, and extension of said front lift cylinder means and said rear lift cylinder means configures said mobile mining machine in a re-gripping configuration in which said front crawler means and said rear crawler means contact the tunnel floor and support the machine, and whereby said front frame portion moves forward relative to said fixed front support means, said fixed rear support means, and said rear frame portion due to forward thrusting of said thrust means when said mobile mining machine is in the gripping configuration, and said fixed front support means, said fixed rear support means and said rear frame portion move forward relative to said front frame portion due to retraction from forward thrusting by said thrust means when said mobile mining machine is in the re-gripping configuration.

6. The mobile mining machine of claim 5, wherein further extension of said front lift cylinder means and said rear lift cylinder means configures said mobile mining machine in a tramming configuration in which said front support pad means and rear support pad means are raised from the tunnel floor.

7. The mobile mining machine of claim 1, wherein said pitch boom assembly means includes four pitch boom cylinders attached to said pitch boom assembly means and to said swing boom assembly means 8. The mobile mining machine of claim 1, wherein said swing boom assembly means includes two swing boom cylinders, attached to said swing boom assembly means and to said frame means.

9. The mobile mining machine of claim 1, further comprising:

a muck apron assembly including a substantially planar center section, a hopper on said center section having a conveyor feed opening adapted to communicate with muck conveyor means, substantially planar wing sections pivotally attached to ends of said center section, wing section swing cylinder means for pivotal movement of said wing sections between a substantially planar orientation with said center section and a substantially perpendicular orientation to said center section, and muck apron lift cylinder means for lifting and lowering said muck apron assembly relative to said mobile mining machine.

10. A mobile mining machine for cutting a tunnel in rock comprising:

a wheel-like cutterhead assembly means for cutting rock, said cutterhead assembly means having a substantially horizontal axis of rotation and having multiple peripherally mounted roller cutter units;

rotation means for rotating said cutterhead assembly means about its horizontal axis;

pitch boom assembly means supporting said cutterhead assembly, said pitch boom assembly means causing movement of said cutterhead assembly in a vertical plane;

swing boom assembly means supporting said pitch boom assembly means, said swing boom assembly means causing movement of said cutterhead assembly and said pitch boom assembly means in a horizontal plane;

frame means supporting said swing boom assembly means, said frame means having a front frame portion and a rear frame portion, said front frame portion and said rear frame portion being interconnected and adapted to reciprocate axially and to rotate with respect to each other;

thrust means connecting said front frame portion and said rear frame portion, said thrust means for thrusting forward said front frame portion, said swing boom assembly means, said pitch boom assembly means and said cutterhead assembly means;

fixed front support means having a front support pad means adapted to anchor against the tunnel floor, and front gripper means adapted to anchor against the tunnel wall, said fixed front support means being slidably mounted on said front frame portion on an axis longitudinal of said mobile mining machine for movement of said fixed front support means and said front frame portion with respect to each other;

fixed rear support means having rear support pad means adapted to anchor against the tunnel floor and rear gripper cylinder means adapted to anchor against the tunnel wall, said fixed rear support means being fixedly mounted on said rear frame portion;

attachment link means connecting said fixed front support means and said fixed rear support means;

front crawler means movable with respect to said front frame portion by front lift cylinder means; and rear crawler means movable with respect to said rear frame portion by rear lift cylinder means whereby retraction of said front lift cylinder means and said rear lift cylinder means configures said mobile mining machine in a gripping configuration in which said front support pad means and said rear support pad means are anchored against the tunnel floor and whereby extension of said lift cylinder means configures said mobile mining machine in a re-gripping configuration in which said front crawler means and said rear crawler means contact the tunnel floor, such that said front frame portion is moved forward relative to said fixed front support means, said fixed rear support means and said rear frame portion due to forward thrusting of said thrust means when said mobile mining machine is in the gripping configuration, and said fixed front support means, said fixed rear support means and said rear frame portion move forward relative to said front frame portion due to retraction from forward thrusting, by said thrust means when said mobile mining machine is in the re-gripping configuration.

11. The mobile mining machine of claim 10, further comprising:

a muck apron assembly including a substantially planar center section, a hopper on said center section having a conveyor feed opening adapted to communicate with muck conveyor means, substantially planar wing sections pivotally attached to ends of said center section, wing section swing cylinder means for pivotal movement of said wing sections between a substantially planar orientation with said center section and a substantially perpendicular orientation to said center section, and apron lift cylinder means connecting said much apron assembly to the front of said mobile mining machine for lifting the lowering said muck apron assembly relative to said mobile mining machine.

12. A holding apparatus for mobile mining machine having a front crawler means, a rear crawler means, and a front frame portion and a rear frame portion interconnected by thrust means and adapted to reciprocate axially with respect to each other, said holding apparatus comprising:

fixed front support means having front support pad means adapted to anchor against the tunnel floor and front gripper cylinder means adapted to anchor against the tunnel wall, said fixed front support means being mounted on the front frame portion to move on an axis longitudinal of said mobile mining machine for movement of said fixed front support means and the front frame portion with respect to each other;

fixed rear support means having rear support pad means adapted to anchor against the tunnel floor and rear gripper cylinder means adapted to anchor against the tunnel wall, said fixed rear support means fixedly mounted on the rear frame portion;

attachment link means connecting said fixed front support means and said fixed rear support means; and lift means connecting the front crawler means and the front frame portion and connecting the rear crawler means and the rear frame portion for configuring said mobile mining machine in a gripping configuration and a re-gripping configuration.

13. The holding apparatus of claim 12, wherein said lift means is comprised of:

front lift cylinder means connecting the front crawler means and the front frame portion; and rear lift cylinder means connecting the rear crawler means and the rear frame portion whereby acuation of said front lift cylinder means and said rear lift cylinder means configures the mobile mining machine in a gripping configuration in which said front support pad means and said rear support pad means are anchored against the tunnel floor and in a re-gripping configuration in which said front crawler means and said rear crawler means contact the tunnel floor without the support pad means being in load supporting contact with the tunnel floor, and whereby the front frame portion moves forward relative to said fixed front support means, said fixed rear support means, and the rear frame portion when the mobile mining machine is in the gripping configuration and the thrust means thrusts forward, and said fixed front support means, said fixed rear support means and the rear frame portion move forward relative to the front frame portion when said mobile mining machine is in the re-gripping configuration and the thrust means retracts from forward thrusting.

14. The mobile mining machine of claim 13, wherein further extension of said front lift cylinder means and said rear lift cylinder means configures said mobile mining machine in a tramming configuration in which said front support pad means and said rear support pad means are raised from the tunnel floor.

15. The holding apparatus of claim 12, further comprising:

guide column means slidably mounted in a guide column channel in said front frame portion for sliding movement of said fixed front support means and the front frame portion with respect to each other; and support trunnion means mounted in a cavity of the front frame portion and fixedly attached to said guide column means, said support trunnion being connected to said front gripper cylinder means and being sized smaller than the cavity for sliding movement of said support trunnion means in the cavity upon sliding movement of said fixed front support means and the front frame portion with respect to each other.

16. A muck apron assembly for a mobile mining machine comprising:

a substantially planar center section adapted to be oriented on the mobile mining machine such that said substantially planar center section is substantially parallel to a tunnel work face;

a hopper on said center section having a conveyor feed opening adapted to communicate with muck conveyor means;

substantially planar wing sections pivotally attached to ends of said center section;

wing section swing cylinder means for pivotal movement of said wing sections between a substantially planar orientation with said center section and a tunnel work face and a substantially perpendicular orientation to said center section and a tunnel work face; and much apron lift cylinder means connecting for lift-up and lowering said much apron assembly relative to the mobile mining machine.

17. A cutterhead positioning assembly and holding apparatus for a mobile mining machine having a cutterhead and a front frame portion and a rear frame portion interconnected by thrust means, said cutterhead positioning assembly and holding apparatus comprising:

pitch boom assembly means supporting said cutterhead and causing vertical movement of said cutterhead;

swing boom assembly means supported by the frame, said swing boom assembly supporting said pitch boom assembly means and causing horizontal movement of said cutterhead and said pitch boom assembly means;

fixed front support means having front support pad means adapted to anchor against the tunnel floor and front gripper cylinder means adapted to anchor against the tunnel wall, said fixed front support means being mounted on the front frame portion to move on an axis longitudinal of said mobile mining machine for movement of said fixed front support means and the front frame portion with respect to each other;

fixed rear support means having rear support pad means adapted to anchor against the tunnel floor and rear gripper cylinder means adapted to anchor against the tunnel wall, said fixed rear support means fixedly mounted on the rear frame portion; and attachment link means connecting said fixed front support means and said fixed rear support means.

18. The cutterhead positioning assembly of claim 17, wherein said pitch boom assembly means includes four pitch boom cylinders attached to the pitch boom assembly means and to said swing boom assembly means.

19. The cutterhead positioning assembly of claim 17, wherein said swing boom assembly includes two swing boom cylinders attached to said swing boom assembly means and to the frame of the mobile mining machine.

* * * * *